US009631162B2

(12) United States Patent
Ramirez

(10) Patent No.: US 9,631,162 B2
(45) Date of Patent: Apr. 25, 2017

(54) FLEXIBLE WICK

(76) Inventor: John Ramirez, Anderson, CA (US)

( * ) Notice: Subject to any disclaimer, the term of this patent is extended or adjusted under 35 U.S.C. 154(b) by 619 days.

(21) Appl. No.: 13/449,886

(22) Filed: Apr. 18, 2012

(65) Prior Publication Data

US 2012/0264069 A1 Oct. 18, 2012

Related U.S. Application Data

(60) Provisional application No. 61/476,601, filed on Apr. 18, 2011.

(51) Int. Cl.

| | |
|---|---|
| ***F23D 3/08*** | (2006.01) |
| ***C11C 5/00*** | (2006.01) |
| ***F23D 3/24*** | (2006.01) |

(52) U.S. Cl.

CPC ..... *C11C 5/006* (2013.01); *C11C 5/008* (2013.01); *F23D 3/08* (2013.01); *F23D 3/24* (2013.01)

(58) Field of Classification Search

CPC .... F23D 3/08; F23D 3/16; F23D 2900/03082; F21V 37/002

USPC ..... 431/298, 325

See application file for complete search history.

(56) References Cited

U.S. PATENT DOCUMENTS

| | | | | | |
|---|---|---|---|---|---|
| 2,029,994 | A | * | 2/1936 | Fabel | 431/325 |
| 2,324,753 | A | * | 7/1943 | Alexiade | 431/323 |
| 2,376,083 | A | * | 5/1945 | Quinn | 431/325 |
| 2,611,254 | A | * | 9/1952 | Byrnes | 431/126 |
| 3,462,235 | A | * | 8/1969 | Summers | 431/289 |
| 3,648,804 | A | * | 3/1972 | Kamp et al. | 184/64 |
| 4,735,568 | A | * | 4/1988 | Izumisawa et al. | 431/325 |
| 5,242,435 | A | * | 9/1993 | Murji et al. | 604/374 |
| 5,387,385 | A | * | 2/1995 | Murji et al. | 264/160 |
| 5,466,516 | A | * | 11/1995 | Lutzow et al. | 428/198 |
| 5,967,769 | A | * | 10/1999 | Thompson | 431/288 |
| D643,554 | S | | 8/2011 | Decker | |
| D644,360 | S | * | 8/2011 | Decker | D26/6 |
| 8,348,662 | B2 | * | 1/2013 | Decker | 431/325 |

(Continued)

FOREIGN PATENT DOCUMENTS

| | | | | |
|---|---|---|---|---|
| CN | 86209496 U | | 12/1987 | |
| FR | 2811676 A1 | * | 1/2002 | C11C 5/006 |

(Continued)

OTHER PUBLICATIONS

FR 2811676 A1—English machine translation.*

(Continued)

*Primary Examiner* — Jorge Pereiro

(74) *Attorney, Agent, or Firm* — Frost Brown Todd LLC

(57) ABSTRACT

A candle wick includes a first layer of paper or dried pulp and a second layer of material selected from the group consisting of paper, silk, thread, textiles, corn fiberfill, cotton batting, bamboo fiber, soybean protein fiber, wood, alpaca hair, dried pulp, rosin, resin, and fibrous material. The first layer is attached to the second layer to form a candle wick that is pliable and shapeable from a generally flat shape to a generally curved shaped. When ignited, the material comprising the candle wick is capable of providing sufficient fuel to a flame to provide a substantially consistent burn from an upper portion to a lower portion. A wick clip includes a slot similarly sized and shaped to receive an undersurface of the pliable, shaped configuration of the candle wick. The candle wick and wick clip form a clip assembly.

20 Claims, 11 Drawing Sheets

(56) References Cited

U.S. PATENT DOCUMENTS

| | | | | |
|---|---|---|---|---|
| D678,558 | S * | 3/2013 | Decker | D26/6 |
| D705,459 | S * | 5/2014 | Decker | D26/6 |
| 2003/0134246 | A1 | 7/2003 | Gray et al. | |
| 2004/0008509 | A1* | 1/2004 | Decker et al. | 362/159 |
| 2004/0009447 | A1* | 1/2004 | Decker | 431/288 |
| 2005/0037307 | A1* | 2/2005 | Decker et al. | 431/320 |
| 2005/0037308 | A1* | 2/2005 | Decker | 431/325 |
| 2006/0172242 | A1* | 8/2006 | Collard | 431/289 |
| 2011/0024945 | A1* | 2/2011 | Decker | 264/279 |
| 2011/0027735 | A1* | 2/2011 | Decker | 431/288 |
| 2011/0027736 | A1* | 2/2011 | Decker | 431/289 |
| 2011/0027737 | A1* | 2/2011 | Decker | 431/289 |
| 2012/0091221 | A1* | 4/2012 | Levake et al. | 239/44 |
| 2012/0148966 | A1 | 6/2012 | Ramaker et al. | |
| 2012/0148967 | A1* | 6/2012 | Thomas | 431/325 |
| 2012/0202160 | A1* | 8/2012 | Ford | 431/289 |
| 2012/0225392 | A1* | 9/2012 | Decker | 431/288 |

FOREIGN PATENT DOCUMENTS

| | | | |
|---|---|---|---|
| GB | 190904937 A | * | 0/1910 |
| WO | WO 00/12656 | | 3/2000 |
| WO | WO 00/43472 | | 7/2000 |
| WO | WO 03/022979 | | 3/2003 |

OTHER PUBLICATIONS

International Search Report and Written Opinion dated Jul. 27, 2012 for Application No. PCT/US2012/034047.

Chinese Office Action dated Sep. 30, 2014 for Application No. 2012800179307.

Australian Office Action dated Apr. 24, 2015 for Application No. 2012245551, 3 pgs.

Chinese Office Action dated Aug. 18, 2015 for Application No. 2012800179307.0, 21 pgs.

* cited by examiner

FLEXIBLE WICK

PRIORITY

This application claims priority to U.S. Provisional Patent Application Ser. No. 61/476,601, filed Apr. 18, 2011, entitled "RIBBON WICK," the disclosure of which is incorporated by reference herein.

BACKGROUND

A candle wick conducts fuel, such as melted candle wax, to a candle flame. It can be made of absorbent materials or materials with sufficient capillary action. The fuel vaporizes and combusts when it reaches the candle flame via the wick, allowing the candle to continue burning. The wick and its characteristics influence how the candle burns. The present invention relates to a candle wick of a particularly advantageous configuration.

BRIEF DESCRIPTION OF THE DRAWINGS

While the specification concludes with claims which particularly point out and distinctly claim the invention, it is believed the present disclosure will be better understood from the following description of certain examples taken in conjunction with the accompanying drawings, in which like reference numerals identify the same elements and in which:

Figure 1:
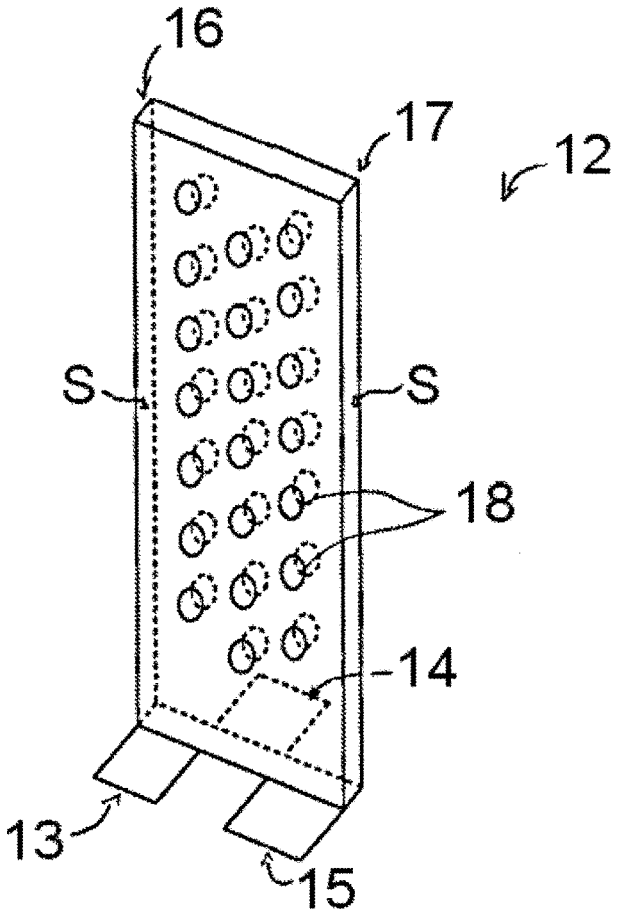
FIG. 1 depicts a perspective view of an exemplary candle wick according to an embodiment of the present disclosure.

The drawings are not intended to be limiting in any way, and it is contemplated that various embodiments of the present disclosure may be carried out in a variety of other ways, including those not necessarily depicted in the drawings. The accompanying drawings incorporated in and forming a part of the specification illustrate several aspects of the present disclosure, and together with the description serve to explain the principles of the present disclosure; it being understood, however, that this disclosure is not limited to the precise arrangements shown.

DETAILED DESCRIPTION

The present disclosure provides a candle wick that has a generally flat or planar aspect and is pliable and able to be shaped.

A candle wick according to an embodiment of the present disclosure includes one or more layers and is capable of absorbing fuel and/or having sufficient capillary action, in either case to deliver fuel to a flame. When ignited by a flame, the candle wick provide a substantially consistent burn from an upper portion to a lower portion such that the flame remains kindled and does not burn out as the candle wick material is capable of providing sufficient fuel to the flame.

Further, each layer may be comprised of a perforated or non-perforated generally vertically self supporting material that is horizontally pliant. Such materials are known in the art and may include, for example, paper, silk, organic and/or inorganic thread, organic and/or inorganic textiles, corn fiberfill, cotton batting, bamboo fiber, soybean protein fiber, wood, alpaca hair, dried pulp, rosin, resin, or fibrous material. The paper may comprise, for example, newsprint paper, construction paper, pulp, and/or any other suitable paper as will be apparent to one of ordinary skill in the art in view of the teachings herein. If more than one layer is used, the layers can be comprised of the same material(s), but that is not required. The layers may be attached to each other in a suitable manner as known to one of ordinary skill in the art in view of the teachings herein, such as, for example, through being sewn together or through use of a sprayable adhesive, non toxic glue, pulp bond, or other non-toxic bonding material.

FIG. 1 illustrates exemplary candle wick (12) comprising a self-standing base that includes feet (13, 14, 15). Additionally or alternatively, candle wick (12) may be received in a substantially similarly shaped slot defined in an exemplary candle wick clip (not shown), as described further below with respect to FIGS. 2-11. Candle wick (12) comprises one or more layers of material that are attached to form a single segment, which forms a generally linear shape between its ends (16, 17). Side sections (S) of candle wick (12) are disposed along the lengths of ends (16, 17) to define an exterior of candle wick (12).

Candle wick (12) includes perforated holes (18) shown as annular holes, though other suitable hole shapes and sizes are possible. Candle wick (12) may be positioned within candle wax (not shown) of a candle jar (not shown) such that candle wick (12) is disposed either diagonally or non-diagonally with respect to the edges of candle jar.

Each layer of candle wick (12) or another candle wick embodiments described herein may be each generally flat or planar yet sufficiently pliable to be shaped into a non-flat or non-planar configuration as a single layer or as part of one or more attached layers forming the candle wick. Each candle wick layer may be extruded, machined, or otherwise formed from a suitable material known to one of ordinary skill in the art in view of the teachings herein to form a pliable piece. Each layer may include a rear face, a front face, and side sections disposed therebetween. A single layered or multi-layered candled wick may form a first configuration comprising a flat shape or a second configuration comprising a curved shape, for example. The curved shape may comprise multiple radii between a first side end and a second side end of the candle wick, such that the curves forming the candle wick do not have the same radius measurements and/or the radii have two different directions (from an inner radius and an outer radius) and/or the radii have multiple directional dimensions such that the path of the flame is divertable along those directions. Alternatively, and as described below, the candle wick may comprise two or more separate, discrete segments that are receivable in a wick clip to form a shaped candle wick.

Examples of Candle Wick Construction

Any of the candle wick embodiments described herein, or other candle wick embodiments as will be apparent to those of skill in the art in view of the teachings herein, may comprise (but are not limited to) one of the following described constructions. The candle wick may comprise a single layer or two or more layers of perforated or non-perforated paper material or other material as described above, wherein the same or different material may be used with multiple layer constructions. Options for combinations of materials in multiple layer constructions may include, but are not limited to, the following variations: (1) an exterior portion comprising two layers of perforated paper, an interior portion comprising a single layer of silk gauze, and an opposite exterior portion comprising two layers of perforated paper; (2) an exterior portion comprising a single layer of perforated paper, an interior portion comprising a single layer of silk gauze, and an opposite exterior portion comprising a single layer of perforated paper; (3) an exterior portion comprising two layers of perforated paper, an interior portion comprising a single layer of silk gauze, and an opposite exterior portion comprising a single layer of perforated paper; (4) an exterior portion comprising three layers of perforated paper, an interior portion comprising a single layer of silk gauze, and an opposite exterior portion comprising three layers of perforated paper; (5) an exterior portion comprising three layers of perforated paper, an interior portion comprising a single layer of silk gauze, and an opposite exterior portion comprising two layers of perforated paper; (6) an exterior portion comprising a single layer of dried pulp, an interior portion comprising a single layer of at least one of bamboo fiber, corn fiberfill, soybean protein fiber, or alpaca hair, and an opposite exterior portion comprising a single layer of dried pulp; (7) an exterior portion comprising a single layer of paper, and an opposite exterior portion comprising a single layer of at least one of an organic or non-organic textile; (8) an exterior portion having opposing exterior faces, the exterior portion comprising two or more layers of perforated paper; and (9) an exterior portion having opposing exterior faces, the exterior portion comprising a single layer of silk gauze comprising each exterior face, the layers of silk gauze sewn or embroidered together with silk, thread, or other suitable material. Other candle wick constructions may include, for example, pulp with a non-toxic fiber core, a pulp exterior with a fibrous core, or a silk exterior with a paper core.

Whether the candle wick is formed of a single or multiple segments, each segment comprises a first end, a second end, and intermediate section disposed between the first end and the second end. An alignment axis intersects the first end and the second end. The intermediate section comprises at least one intermediate portion that is pliable and can be moved away from the alignment axis. Various linear and/or geometric shapes are possible, including, for example, candle wicks comprising straight line shapes, C-curved shapes, S-curved shapes, sinusoidal wave shapes, and including single or multiple radii across first and second ends of a candle wick segment and/or candle wick.

A linear wick height may be determined before the manufacture of a candle wick by measuring a candle container height to determine a suitable candle wick height. The embodiments of the candle wicks disclosed herein may comprise a horizontal length equal to or greater than about 1/16 inches (to an unlimited maximum).

The present candle wick embodiments may be used in any candle configuration. For example, each candle wick can be used in a free-standing candle or in a candle contained within a receiving container. The receiving container may be, for example, a candle jar. The jar may be made of glass or any other suitable material. The jar may be configured to contain a candle fuel, such as wax.

A wick clip holds a wick in place during manufacture of the candle. It also is a safety device that provides a barrier between whatever is beneath the candle (such as a jar or other holder) and the flame. In addition, it holds the end of the wick above a pool of melted wax. The present candle wick can be used with any wick clip that will provide these features. The wick clip may be constructed and operable in accordance with at least some of the teachings of U.S. patent application Ser. No. 13/325,167, entitled "CANDLE WICK AND WICK CLIP," filed Dec. 14, 2011, the disclosure of which is incorporated by reference herein.

A wick clip according to an embodiment of the present disclosure is sized and shaped to receive a similarly shaped configuration of the candle wick. The wick clip advantageously supports the candle wick in an upright manner such that candle wick may remain in an upright position when inserted in a container such as a candle jar, as described below. The wick clip further advantageously provides a safer assembled candle, as the wick clip substantially prevents the candle wick from touching a container surface, such as a bottom surface of the container into which a clip assembly comprising the candle wick and wick clip is received. As another safety feature, the wick clip advantageously holds the wick above and out of the candle fuel at the end of the candle's life.

If the wick clip is used in a container, an underside of any of the wick clip embodiments disclosed herein is attachable and securable to an upper surface of a receiving container. A utilized wick clip may be attached to the container via any suitable manner as known to one of ordinary skill in the art in view of the teachings herein. The wick clip may be attached to the container via an adhesive, as described below. The wick clip may first be attached to the container and then may receive the candle wick that it is shaped to receive. Alternatively, the wick clip and candle wick may first be engaged to form the clip assembly, and the undersurface of the wick clip may then be attached to the container.

After the clip assembly is secured in the container such that the wick clip stands substantially upright, such fuel may be poured into the container. For example, hot wax may be poured into a candle jar about the clip assembly and up until a level just below a top portion of the candle wick. The hot wax may then cool about the clip assembly, as described further below with respect to the Figures. Additionally or alternatively, a wick centering device may be used to further assist with setting the position of the candle wick until the wax has cooled.

Examples of Candle Wick Shapes and Similar Wick Clip Shapes

Figure 2:
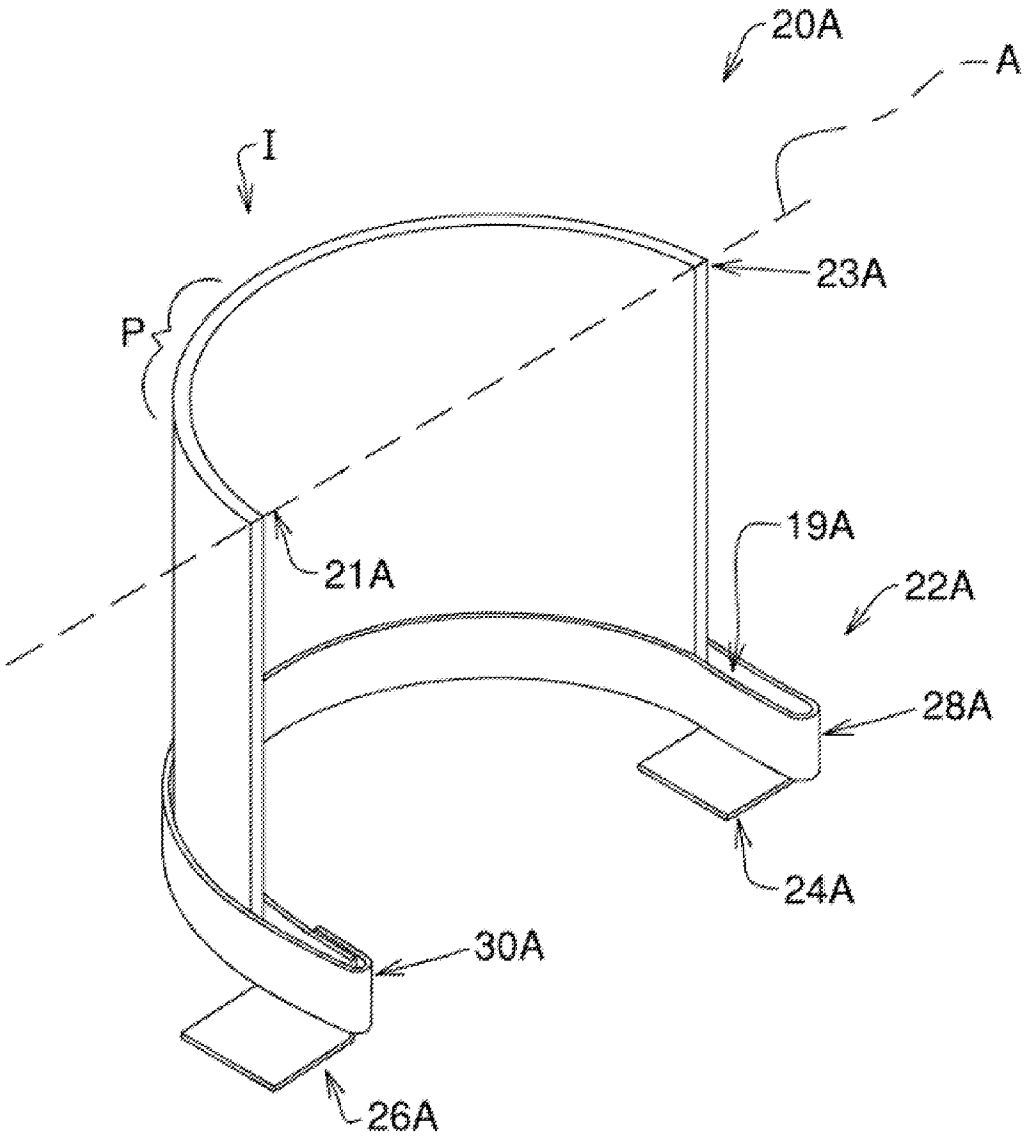
FIG. 2 depicts a perspective view of another exemplary candle wick and wick clip according to an embodiment of the present disclosure.
Figure 3:
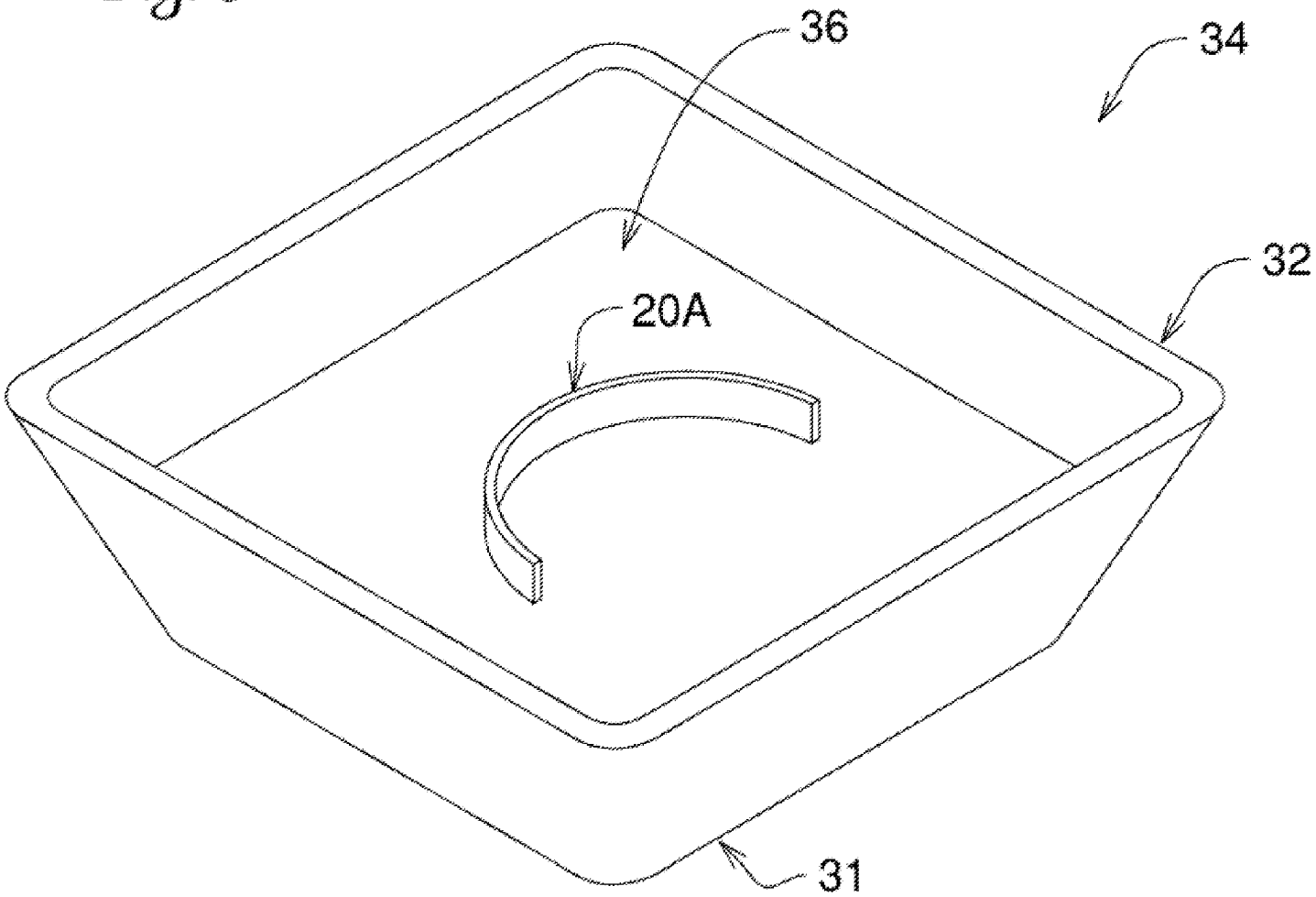
FIG. 3 depicts a perspective view of a candle jar filled with candle wax surrounding the exemplary candle wick of FIG. 2.
Figure 4:
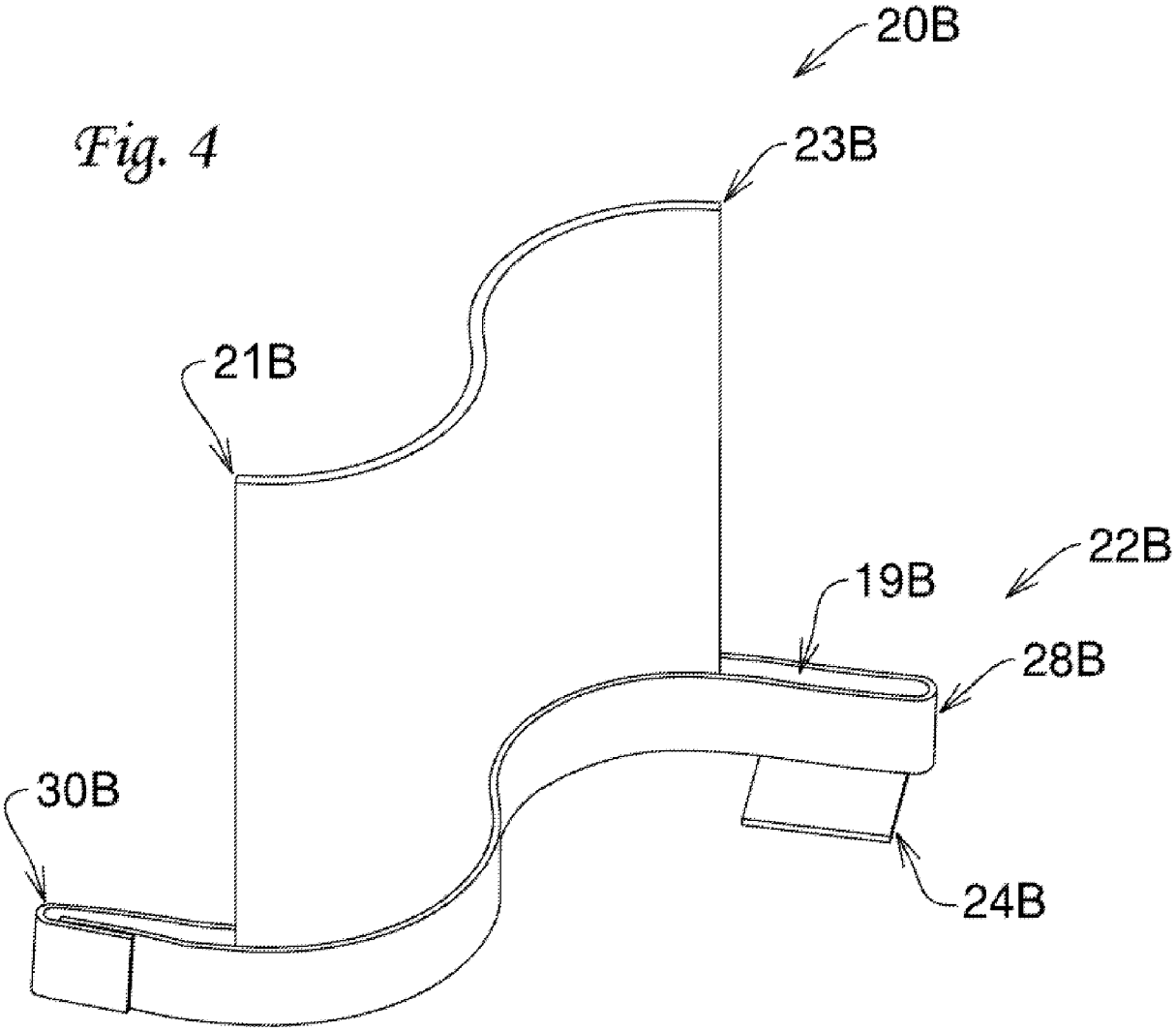
FIG. 4 depicts a perspective view of another exemplary candle wick and wick clip according to an embodiment of the present disclosure.

Candle wicks as described above are pliable and shapeable into different configurations, such as the curved configurations shown in FIGS. 2-11. The reference numbers used for like components of candle wick (20A) and wick clip (22A) of FIGS. 2-3 are also used for FIGS. 4-11. The different embodiments are presented with similar reference numbers having different alphanumeric characters (for example, FIG. 4 shows candle wick (20B) and wick clip (22B)). The similarities between the versions herein will generally not be further discussed.

FIG. 2 illustrates exemplary candle wick (20A) received in a slot defined in exemplary candle wick clip (22A). FIG. 3 shows candle (34) including candle jar (32), which includes bottom portion (31) and sidewalls that house candle wax (36) and one embodiment of candle wick (20A). Candle wick (20A) is surrounded by candle wax (36).

Referring back to FIG. 2, candle wick (20A) forms a generally curved, C-shaped shape; wick clip (22A) includes a generally curved, C-shaped slot (19A) configured to receive an underside of C-shaped candle wick (20A). Wick clip (22A) includes a pair of feet (24A, 26A) that horizontally extend from respective first and second ends (28A, 30A) of wick clip (22A). Wick clip (22A), and any of the wick clips of the embodiments disclosed herein, may comprise a metal, plastic, or any other suitable material.

An alignment axis (A) intersects ends of candle wick (20A), depicted in FIG. 2 as ends (21A, 23A). Candle wick (20A) includes an intermediate section (I) disposed between ends (21A, 23A) of candle wick (20A). Intermediate section (I) includes at least one intermediate portion (P) that is spaced away from alignment axis (A) in a final configuration of candle wick (20A). Portion (P) may originally be disposed along alignment axis (A) and may be pliably moved to a position spaced away from alignment axis (A) to form a curved configuration, for example, for candle wick (20A). While an alignment axis (A), intermediate section (I), and portion (P) are not depicted in the Figures for the other candle wick embodiments described herein, each of the candle wicks of the embodiments described herein similarly includes first and second ends that are intersected by an alignment axis, intermediate sections disposed between those first and second ends, and at least one intermediate portion within an intermediate section that is pliable and able to be spaced away from the alignment axis to form a final configuration of candle wick (20A). While the intermediate portion is pliable, the intermediate portion may remain disposed along the alignment axis to form a straight or linear configuration for a candle wick embodiment as shown in FIG. 1, which is described above.

Figure 5:
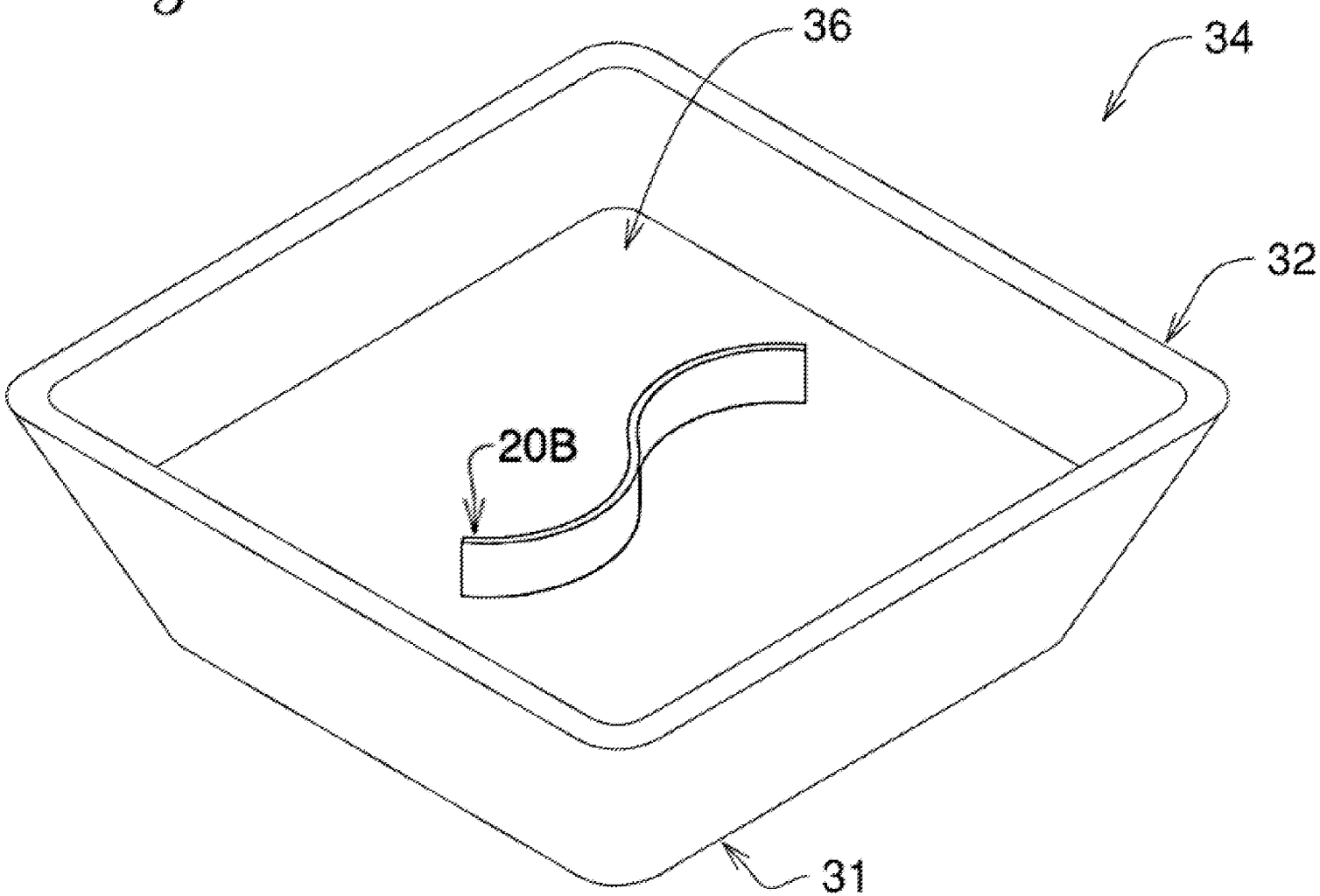
FIG. 5 depicts a perspective view of a candle jar filled with candle wax surrounding the exemplary candle wick of FIG. 4.
Figure 6:
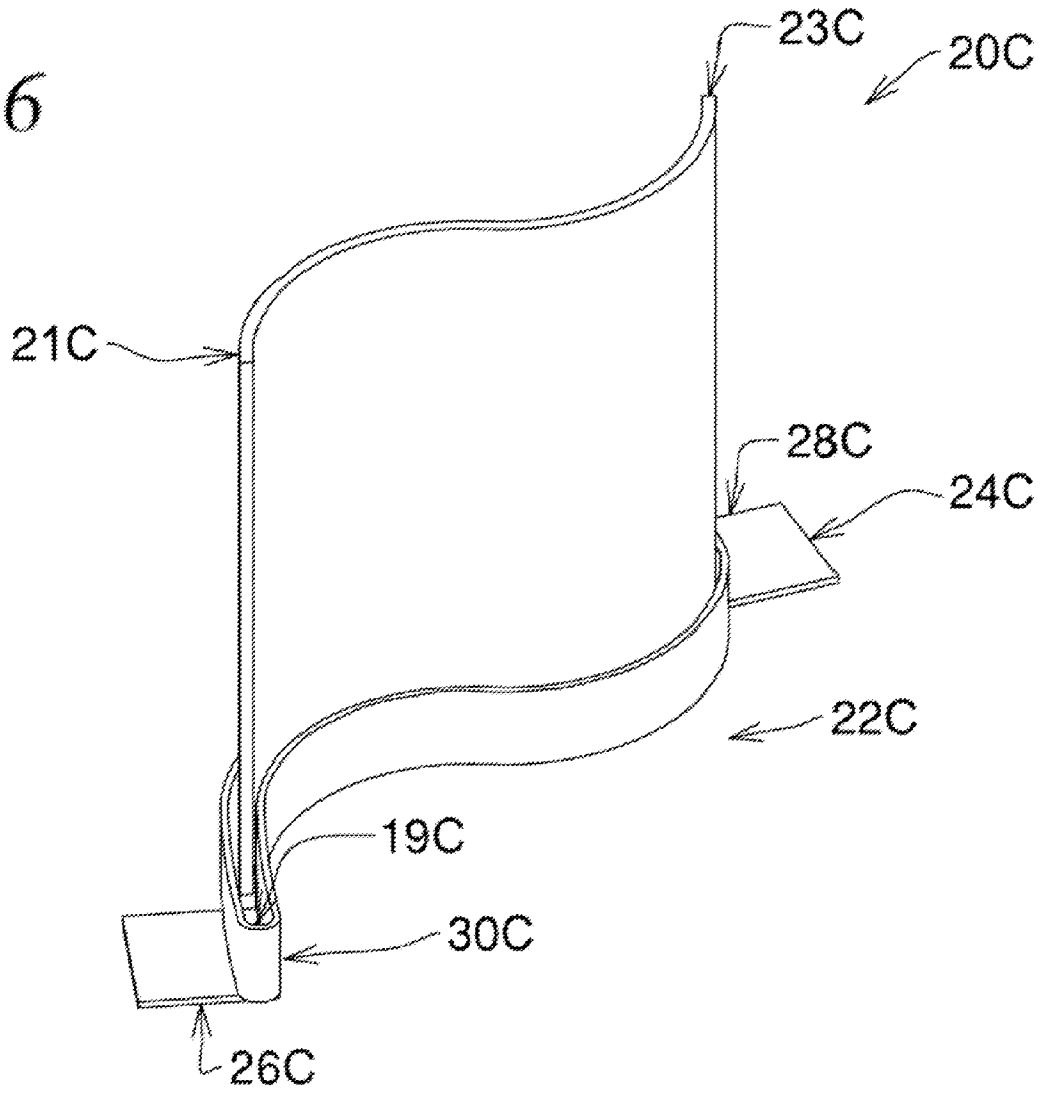
FIG. 6 depicts a perspective view of yet another exemplary candle wick and wick clip according to an embodiment of the present disclosure.
Figure 7:
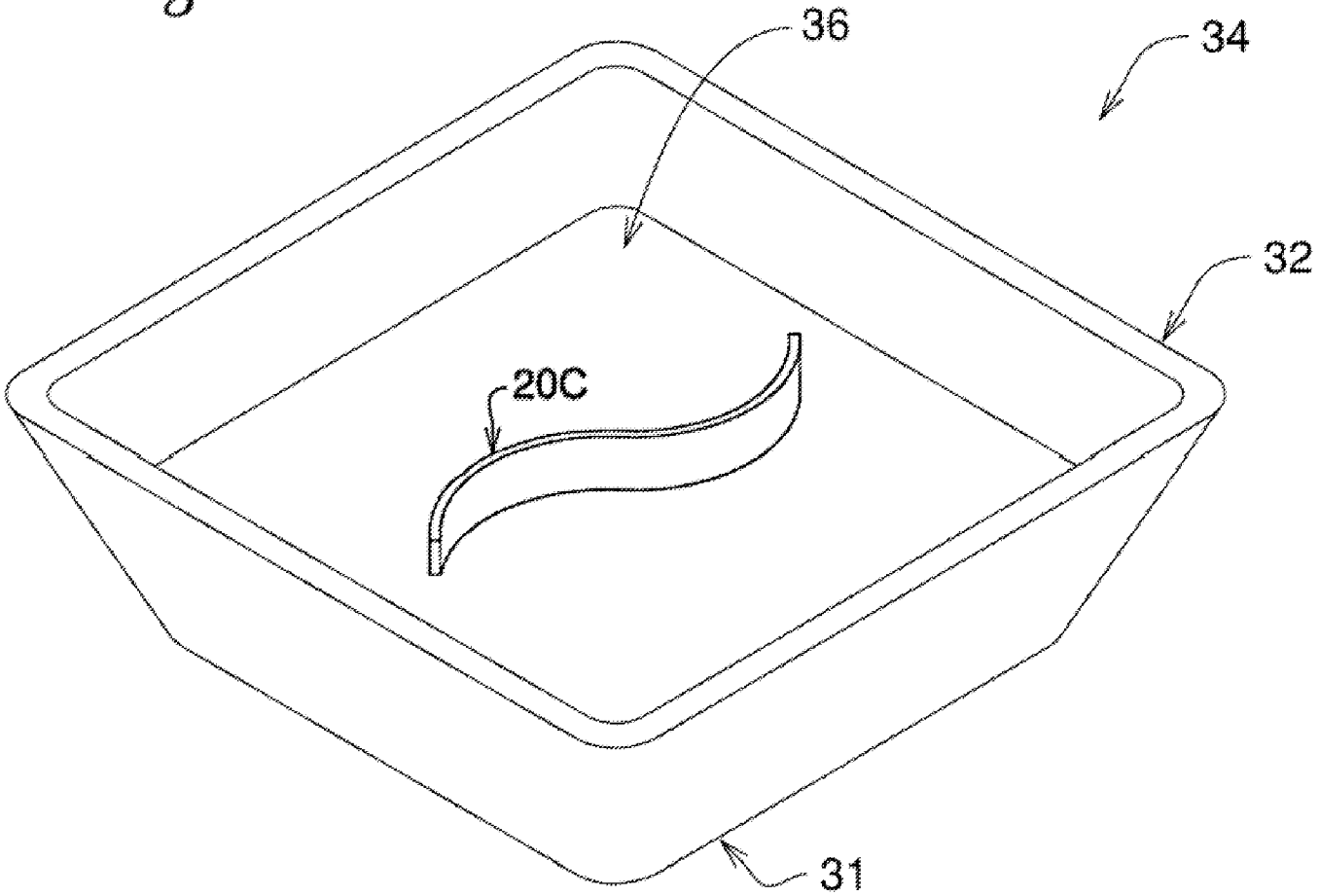
FIG. 7 depicts a perspective view of a candle jar filled with candle wax surrounding the exemplary candle wick of FIG. 6.
Figure 8:
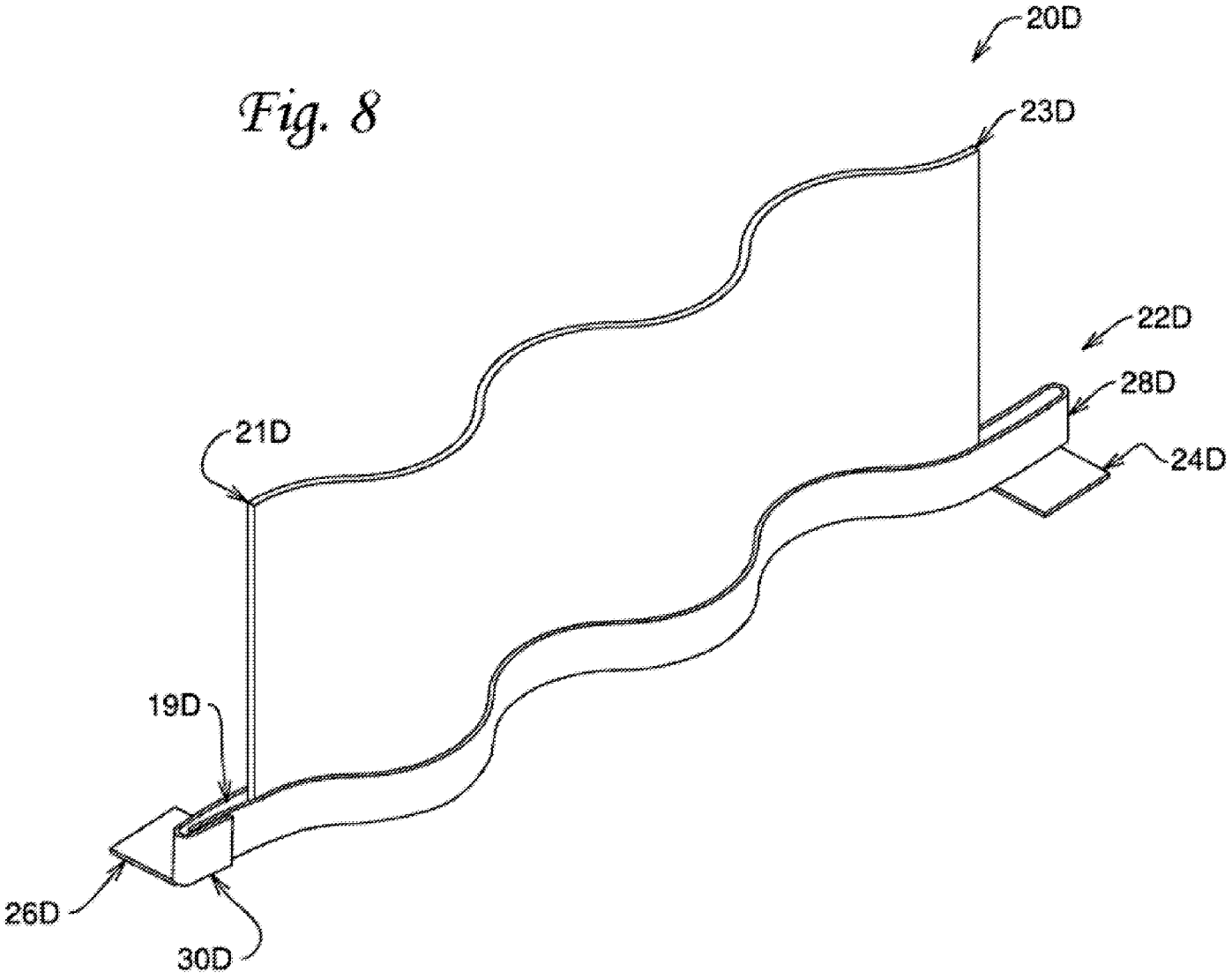
FIG. 8 depicts a perspective view of yet another exemplary candle wick and wick clip according to an embodiment of the present disclosure.
Figure 9:
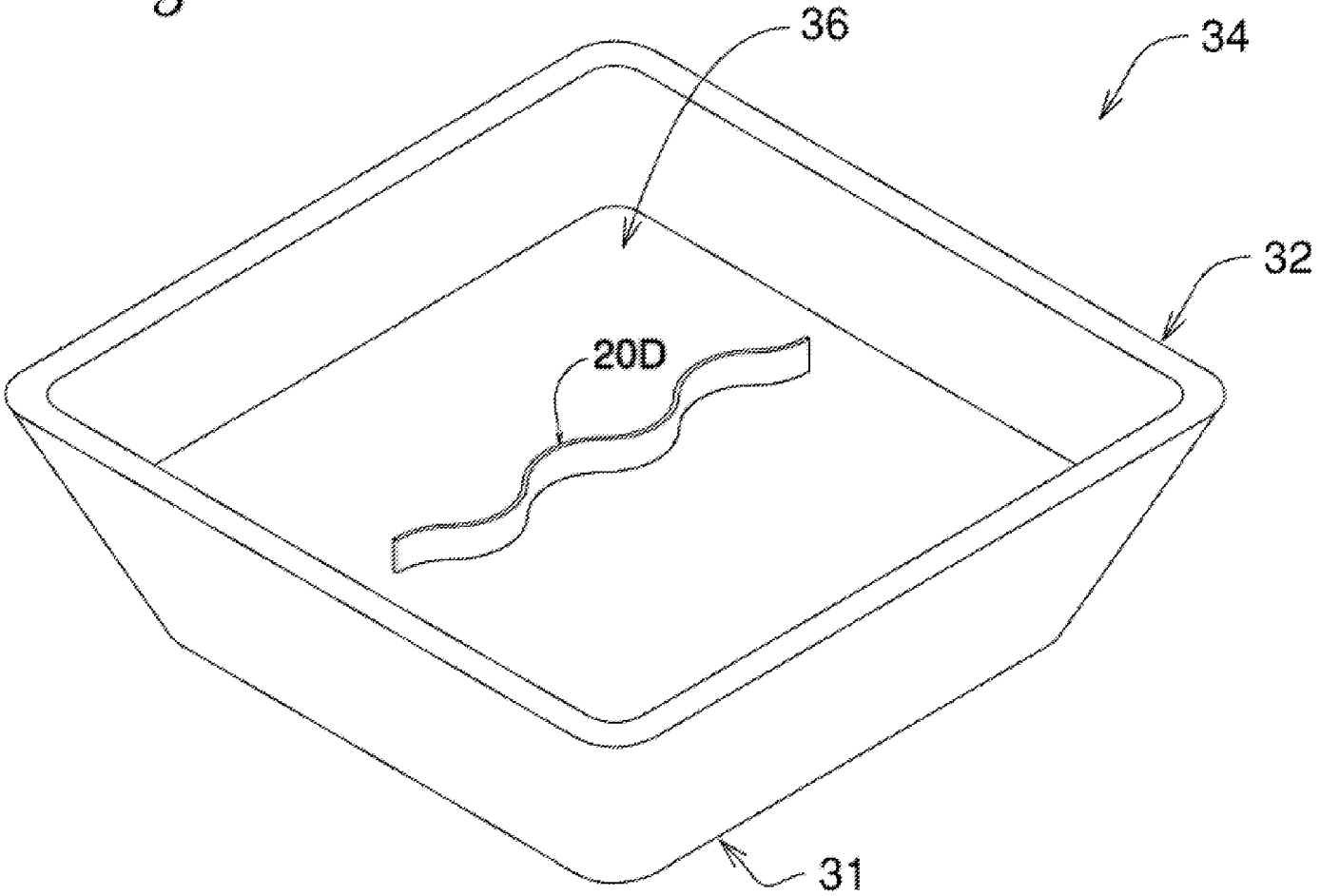
FIG. 9 depicts a perspective view of a candle jar filled with candle wax surrounding the exemplary candle wick of FIG. 8.
Figure 10:
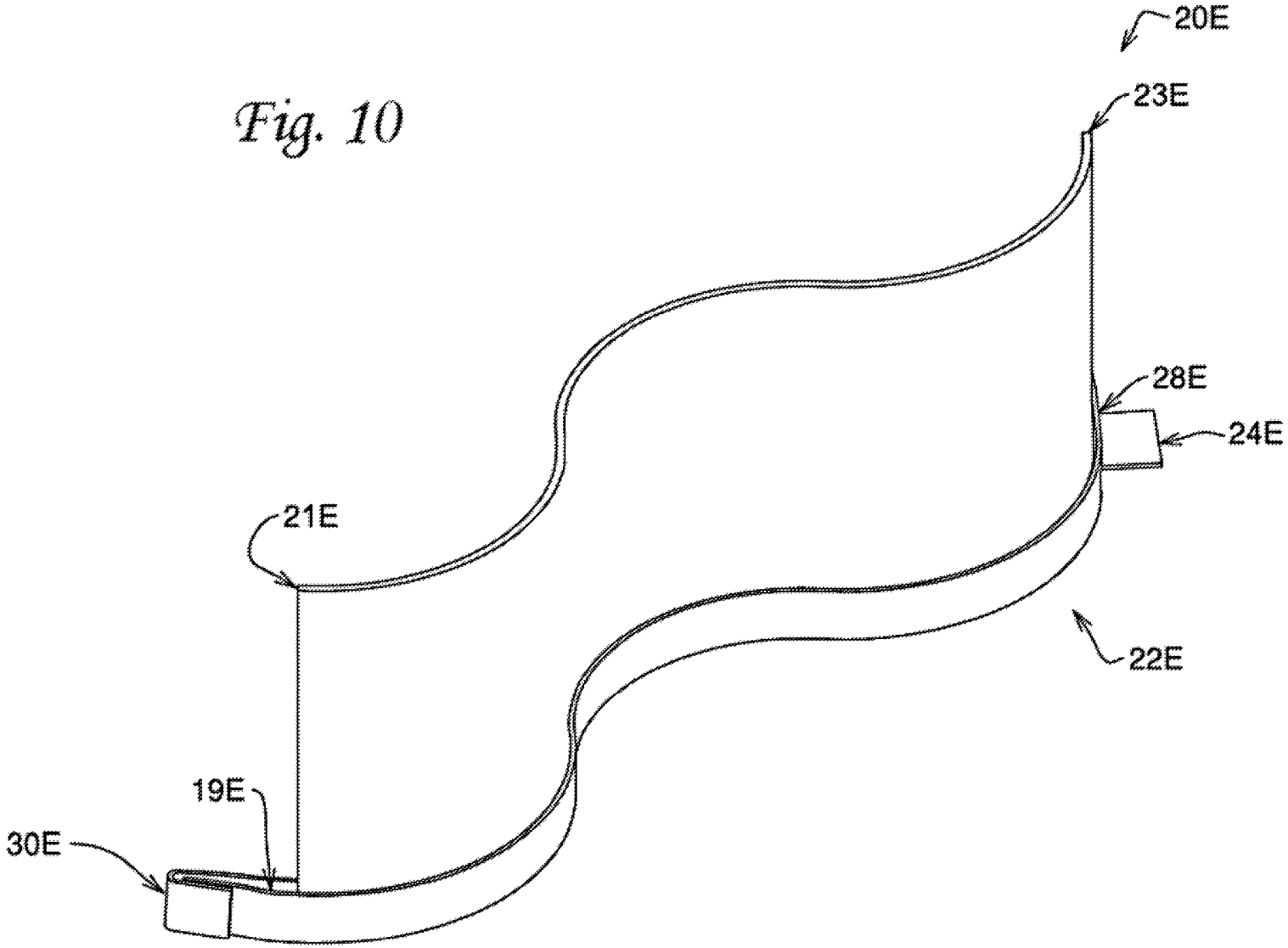
FIG. 10 depicts a perspective view of yet another exemplary candle wick and wick clip according to an embodiment of the present disclosure.
Figure 11:
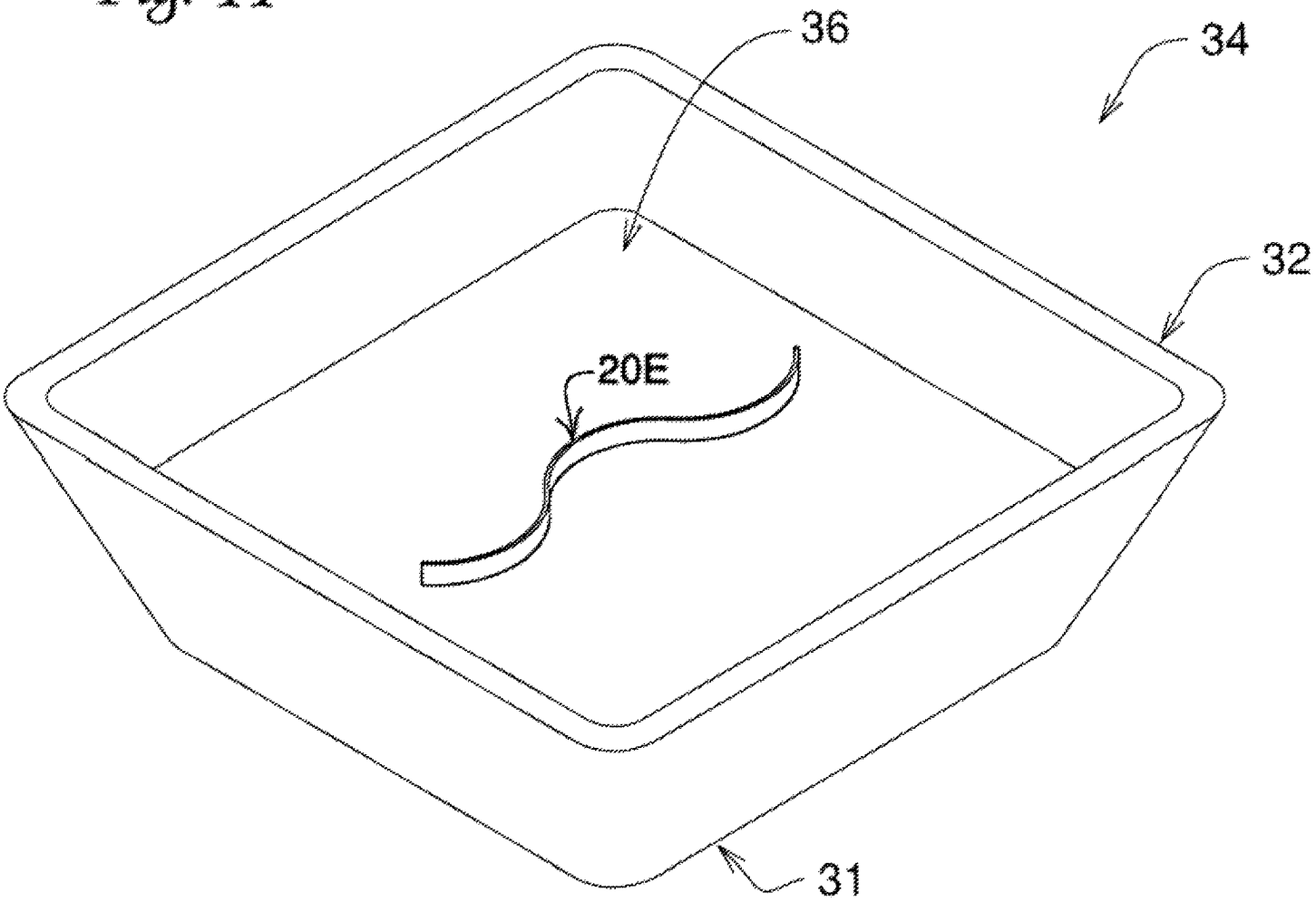
FIG. 11 depicts a perspective view of a candle jar filled with candle wax surrounding the exemplary candle wick of FIG. 10.

FIG. 4 illustrates exemplary generally curved, S-shaped candle wick (20B), and FIG. 5 shows candle wick (20B) surrounded by candle wax (36). FIG. 6 illustrates exemplary generally curved, reverse S-shaped candle wick (20C), and FIG. 7 shows candle wick (20C) surrounded by candle wax (36). FIG. 8 illustrates exemplary generally curved, sinusoidal wave-shaped candle wick (20D), and FIG. 9 shows candle wick (20D) surrounded by candle wax (36). FIG. 10 illustrates exemplary generally curved, reverse sinusoidal wave-shaped candle wick (20E), and FIG. 11 shows candle wick (20E) surrounded by candle wax (36).

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, the examples, embodiments, geometries, materials, dimensions, ratios, steps, and the like discussed above are illustrative. Accordingly, the scope of the present invention should be considered in terms of the following claims and is understood not to be limited to the details of structure and operation shown and described in the specification and drawings.

I claim:

1. A candle wick, comprising:

(a) a first layer of paper; and (b) a second layer of material selected from the group consisting of paper, silk, thread, textiles, corn fiberfill, cotton batting, bamboo fiber, soybean protein fiber, wood, alpaca hair, dried pulp, rosin, resin, fibrous material, and combinations thereof;

wherein the first layer is attached to the second layer, and wherein the first and second layers are configured to be pliable and shapeable to both burn substantially consistently from an upper portion to a lower portion of the candle wick in relation to a fuel;

wherein a first end and a second end of the candle wick define an alignment axis, wherein an intermediate section of the candle wick disposed between the first and second ends is pliably movable to a position spaced away from the alignment axis to form a wave configuration.

2. The candle wick of claim 1, wherein the paper of the first layer is selected from the group consisting of newsprint paper, construction paper, and pulp.

3. The candle wick of claim 1, wherein the thread comprises at least one of an organic or inorganic material.

4. The candle wick of claim 1, wherein the textiles comprise at least one of an organic or inorganic material.

5. The candle wick of claim 1, wherein the candle wick is configured to be pliable and shapeable from a generally flat shape to a generally curved shaped.

6. The candle wick of claim 1, wherein the first layer is attached to the second layer by being one of sewn to the second layer or bonded to the second layer via a non-toxic bonding material selected from the group consisting of a sprayable adhesive, glue, and pulp.

7. The candle wick of claim 1, further comprising a third layer, a fourth layer, and a fifth layer, wherein the first, third, fourth, and fifth layers comprise perforated paper, wherein the first and third layers comprise a first exterior portion, wherein the fourth and fifth layers comprise a second exterior portion, and wherein the second layer is disposed between the first exterior portion and the second exterior portion and comprises silk gauze.

8. The candle wick of claim 1, further comprising a third layer, wherein the first and third layers comprise perforated paper, and wherein the second layer is disposed between the first and third layers and comprises silk gauze.

9. The candle wick of claim 1, further comprising a third layer and a fourth layer, wherein the first, third, and fourth layers comprise perforated paper, wherein the first and third layers comprise a first exterior portion, wherein the fourth layer comprises a second exterior portion, and wherein the second layer is disposed between the first exterior portion and the second exterior portion and comprises silk gauze.

10. The candle wick of claim 1, further comprising a third layer, a fourth layer, a fifth layer, a sixth layer, and a seventh layer, wherein the first, third, fourth, fifth, sixth, and seventh layers comprise perforated paper, wherein the first, third, and fourth layers comprise a first exterior portion, wherein the fifth, sixth, and seventh layers comprise a second exterior portion, and wherein the second layer is disposed between the first exterior portion and the second exterior portion and comprises silk gauze.

11. The candle wick of claim 1, further comprising a third layer, a fourth layer, a fifth layer, and a sixth layer, wherein the first, third, fourth, fifth, and sixth layers comprise perforated paper, wherein the first, third, and fourth layers comprise a first exterior portion, wherein the fifth and sixth layers comprise a second exterior portion, and wherein the second layer is disposed between the first exterior portion and the second exterior portion and comprises silk gauze.

12. The candle wick of claim 1, further comprising a third layer, wherein the first and third layers comprise dried pulp, wherein the first layer comprises a first exterior portion, wherein the third layer comprises a second exterior portion, wherein the second layer is disposed between the first exterior portion and the second exterior portion, and wherein the second layer comprises at least one of bamboo fiber, corn fiberfill, soybean protein fiber, or alpaca hair.

13. The candle wick of claim 1, wherein the first layer comprises a first exterior portion, wherein the second layer comprises a second exterior portion, and wherein the second layer comprises at least one of an organic or non-organic textile.

14. The candle wick of claim 1, wherein the candle wick comprises an exterior portion having a first exterior face and a second, opposing exterior face, and wherein the exterior portion comprises two or more layers of perforated paper.

15. The candle wick of claim 1, further comprising layers of silk gauze, wherein the candle wick comprises an exterior portion having a first exterior face and a second, opposing exterior face, and wherein each exterior face comprises silk gauze, wherein the layers of silk gauze are configured to be sewn together with at least one of silk or thread.

16. The candle wick of claim 1, further comprising a third layer, wherein the first and third layers comprise pulp, wherein the first layer comprises a first exterior portion, wherein the third layer comprises a second exterior portion, wherein the second layer is disposed between the first exterior portion and the second exterior portion, and wherein the second layer comprises a fiber.

17. The candle wick of claim 1, further comprising a third layer, wherein the second and third layers comprise silk, wherein the second layer comprises a first exterior portion, wherein the third layer comprises a second exterior portion, and wherein the first layer is disposed between the first exterior portion and the second exterior portion.

18. A candle wick, comprising:

(a) a first layer of dried pulp; and (b) a second layer of material selected from the group consisting of paper, silk, thread, textiles, corn fiberfill, cotton batting, bamboo fiber, soybean protein fiber, wood, alpaca hair, dried pulp, rosin, resin, fibrous material, and combinations thereof;

wherein the first layer is attached to the second layer, and wherein the first and second layers are configured to be pliable and shapeable to both burn substantially consistently from an upper portion to a lower portion of the candle wick in relation to a fuel;

wherein a first end and a second end of the candle wick define an alignment axis, wherein an intermediate section of the candle wick disposed between the first and second ends is pliably movable to a position spaced away from the alignment axis to form a wave configuration.

19. A candle assembly, comprising:

(a) a candle wick comprising:

(i) a first layer of paper; and (ii) a second layer of material selected from the group consisting of paper, silk, thread, textiles, corn fiberfill, cotton batting, bamboo fiber, soybean protein fiber, wood, alpaca hair, dried pulp, rosin, resin, fibrous material, and combinations thereof;

wherein the first layer is attached to the second layer, and wherein the first and second layers are configured to be pliable and shapeable to both burn substantially consistently from an upper portion to a lower portion of the candle wick in relation to a fuel;

wherein a first end and a second end of the candle wick define an alignment axis, wherein an intermediate section of the candle wick disposed between the first and second ends is pliably movable to a position spaced away from the alignment axis to form a wave configuration; and (b) a wick clip, the wick clip comprising a slot sized and shaped to receive the candle wick; and (c) a container, the container configured to securely receive the wick clip.

20. The candle assembly of claim 19, wherein the container is configured to receive wax, wherein the wick clip comprises a material selected from the group consisting of metal and plastic, and wherein the first and second layers of material are attachable by being one of sewn or bonded via a bonding material to an adjacent layer, wherein bonding material is selected from the group consisting of a sprayable adhesive, glue, and pulp.

* * * * *